United States Patent [19]

Dennis et al.

[11] 4,342,182

[45] Aug. 3, 1982

[54] CARD FOLDING AND CREASING DEVICE

[75] Inventors: Edmund G. Dennis, Belle Terre; C. Edward Brandmaier, Centerport, both of N.Y.

[73] Assignee: Cashin Systems Corp., Hauppauge, N.Y.

[21] Appl. No.: 143,491

[22] Filed: Apr. 24, 1980

[51] Int. Cl.[3] ..... B65B 35/54; B65B 49/16

[52] U.S. Cl. ..... 53/156; 53/117; 53/206; 53/209; 53/580; 53/DIG. 1; 493/407; 493/418

[58] Field of Search ..... 53/397, 429, 460, 117, 53/206, 209, 580, DIG. 1, 76, 156, 157; 100/222; 493/399, 418, 437, 438, 450, 407, 465, 466, 254

[56] References Cited

U.S. PATENT DOCUMENTS

| | | | |
|---|---|---|---|
| 2,907,152 | 10/1959 | Hensgen | 53/DIG. 1 |
| 3,002,432 | 10/1961 | Wendshuh | 493/263 |
| 3,079,144 | 2/1963 | Frei | 493/418 |
| 3,113,506 | 12/1963 | Faeber | 100/222 |
| 3,391,616 | 7/1968 | Junco | 493/465 |
| 3,803,795 | 4/1974 | Ouellette | 53/76 |
| 3,908,524 | 9/1975 | Shore | 493/254 |
| 4,279,611 | 7/1981 | Labombarde | 493/418 |

FOREIGN PATENT DOCUMENTS

| | | | |
|---|---|---|---|
| 461740 | 6/1928 | Fed. Rep. of Germany | 53/206 |
| 204743 | 9/1965 | Sweden | 100/222 |

*Primary Examiner*—John Sipos

*Attorney, Agent, or Firm*—Kane, Dalsimer, Kane, Sullivan and Kurucz

[57] ABSTRACT

A card having a product thereon is fed by a conveyor into a card folding device. This involves the use of an air jet located below the conveyor, which is activated and causes the leading portion of the card as it passes thereover to go into an upright position approximately perpendicular to the conveyor. While in this position, the conveyor causes the card to be fed into fingers located above the conveyor which complete the fold rearwardly. While still under the influence of the fingers, the leading edge, or fold line, of the now folded card is fed into a creaser. At this point, a switch is tripped which raises a stop-bar which stops the card. A reciprocal plunger is now activated and is used to crease the leading edge by exerting downward pressure thereon against the stop-bar. Once creasing is completed, the stop-bar and plunger retract allowing the conveyor to take the card and product to the next packaging station.

12 Claims, 12 Drawing Figures

CARD FOLDING AND CREASING DEVICE

FIELD OF THE INVENTION

The present invention relates to the folding and creasing of a card having a sliced product thereon, particularly a card having sliced bacon thereon.

BACKGROUND OF THE INVENTION

In present bacon slicing operations, after the product has been sliced, it is usually packed airtight in a clear plastic wrapping to prevent spoilage and preserve freshness. Rather than have this package inserted into a box for subsequent sale, it has become desirable in certain applications to have the sliced product contained within a folded card, usually made of cardboard, prior to packing it in the clear plastic wrapping. An example of this type of packaging can be seen in the pork product Sizzlean marketed by Swift & Company, Chicago, Ill. 60604.

The card involved is initially completely flat and receives the sliced product on a portion thereof, with the remaining portion of the card subsequently folded over the product. A perforation intermediate the card forward and trailing ends and between said portions is utilized to facilitate the folding. This folding is usually performed manually by a person who removes the package from a conveyor and by hand, folds the card and creases the edge so as to keep its folded position. In high speed production, this necessitates a plurality of persons which leads to considerable expense in operation.

SUMMARY OF THE INVENTION

Accordingly, it is the principal object of the present invention to provide an automatic card folding and creasing device which is of relatively simple construction but which provides for effective operation and eliminates the need for manual labor in this regard.

In the present invention, a card having a product thereon is fed by a conveyor into a card folding device. This involves the use of an air jet located below the conveyor, which is activated and causes the leading portion of the card as it passes thereover to go into an upright position approximately perpendicular to the conveyor. While in this position, the conveyor causes the card to be fed into fingers located above the conveyor which complete the fold rearwardly.

While still under the influence of the fingers, the leading edge, or fold line, of the new folded card is fed into a creaser. At this point, a switch is tripped which raises a stop-bar which stops the card. A reciprocal plunger is now activated and is used to crease the leading edge by exerting downward pressure thereon against the stop-bar. Once creasing is completed, the stop-bar and plunger retract allowing the conveyor to take the card and product to the next packaging station.

BRIEF DESCRIPTION OF THE DRAWINGS

The above-mentioned features and objects of this invention will become more apparent by reference to the following description taken in conjunction with the accompanying drawings in which.

DETAILED DESCRIPTION OF THE PREFERRED EMBODIMENT

Figure 1:
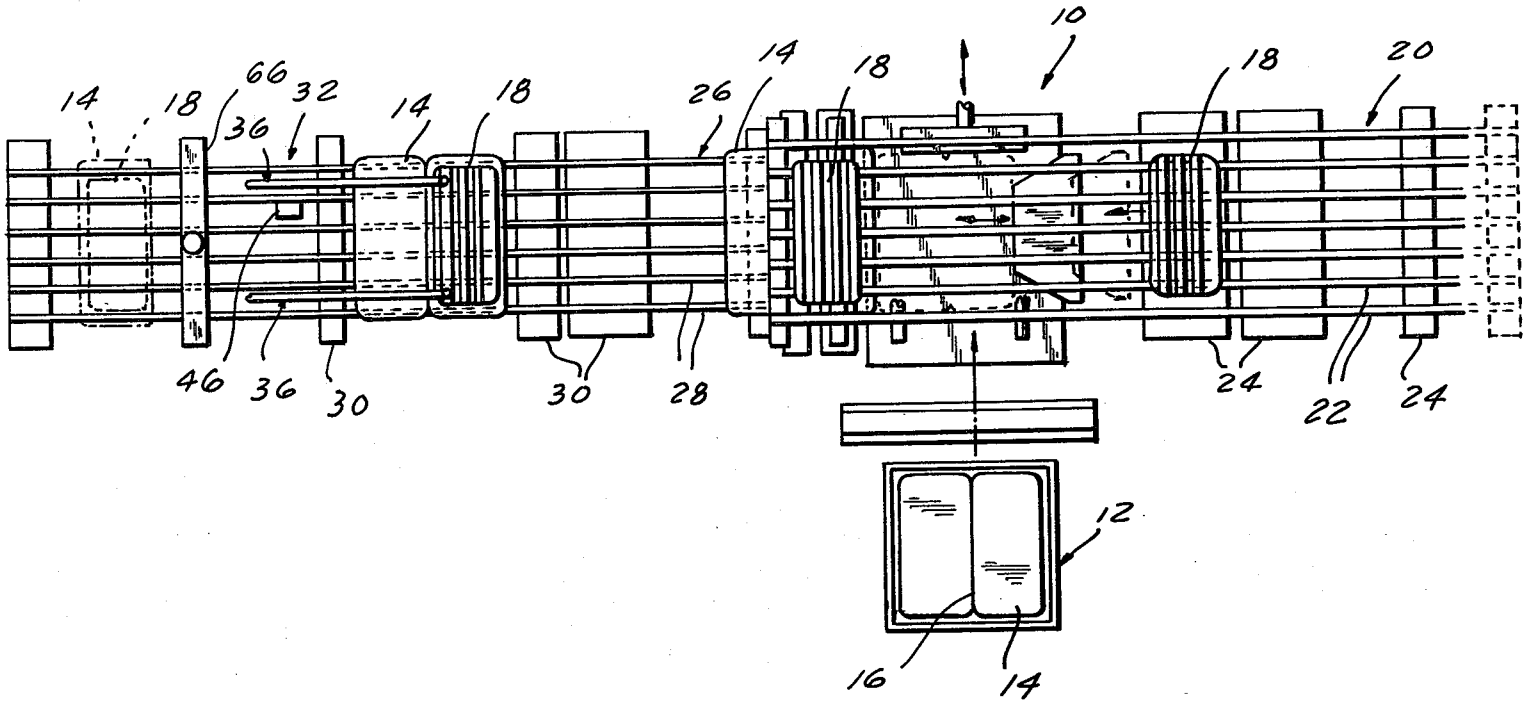
FIG. 1 is a somewhat schematic top plan view of a conveyor system having a card folding and creasing device incorporating the teachings of the present invention.
Figure 2:
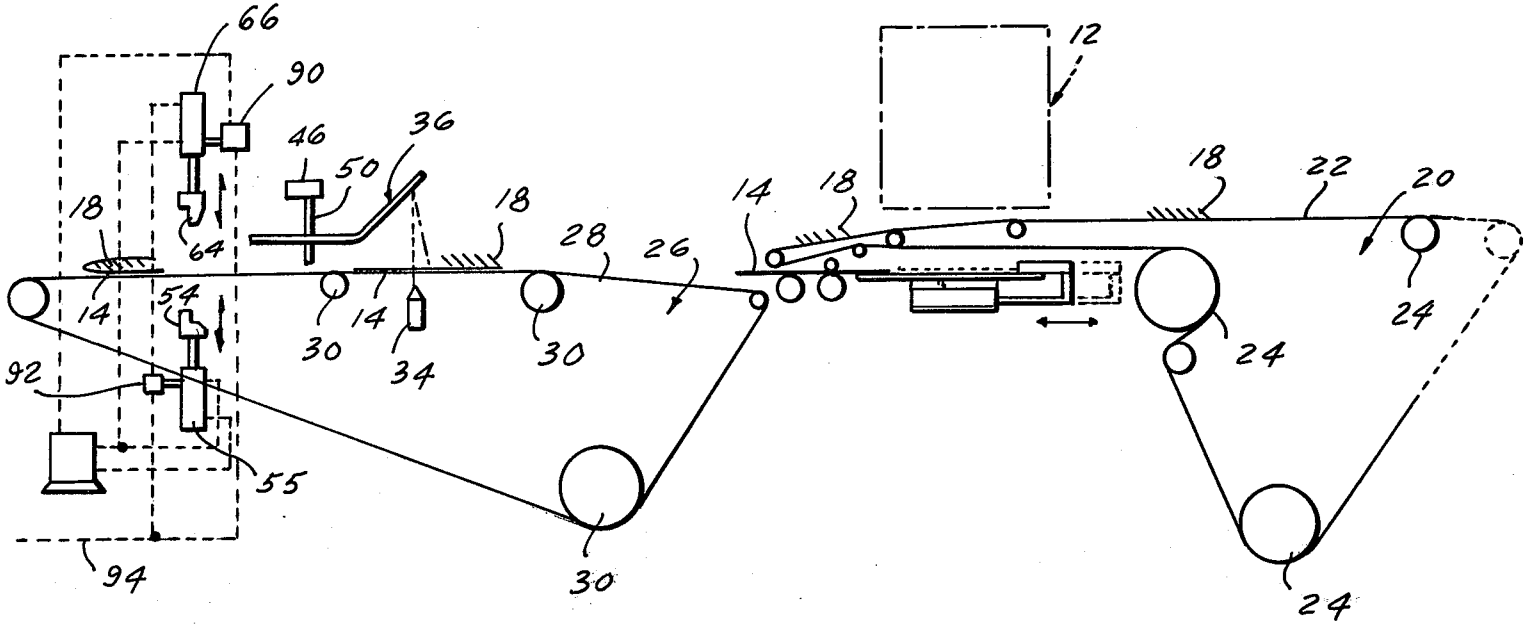
FIG. 2 is a somewhat schematic side elevation view thereof.
Figure 3:
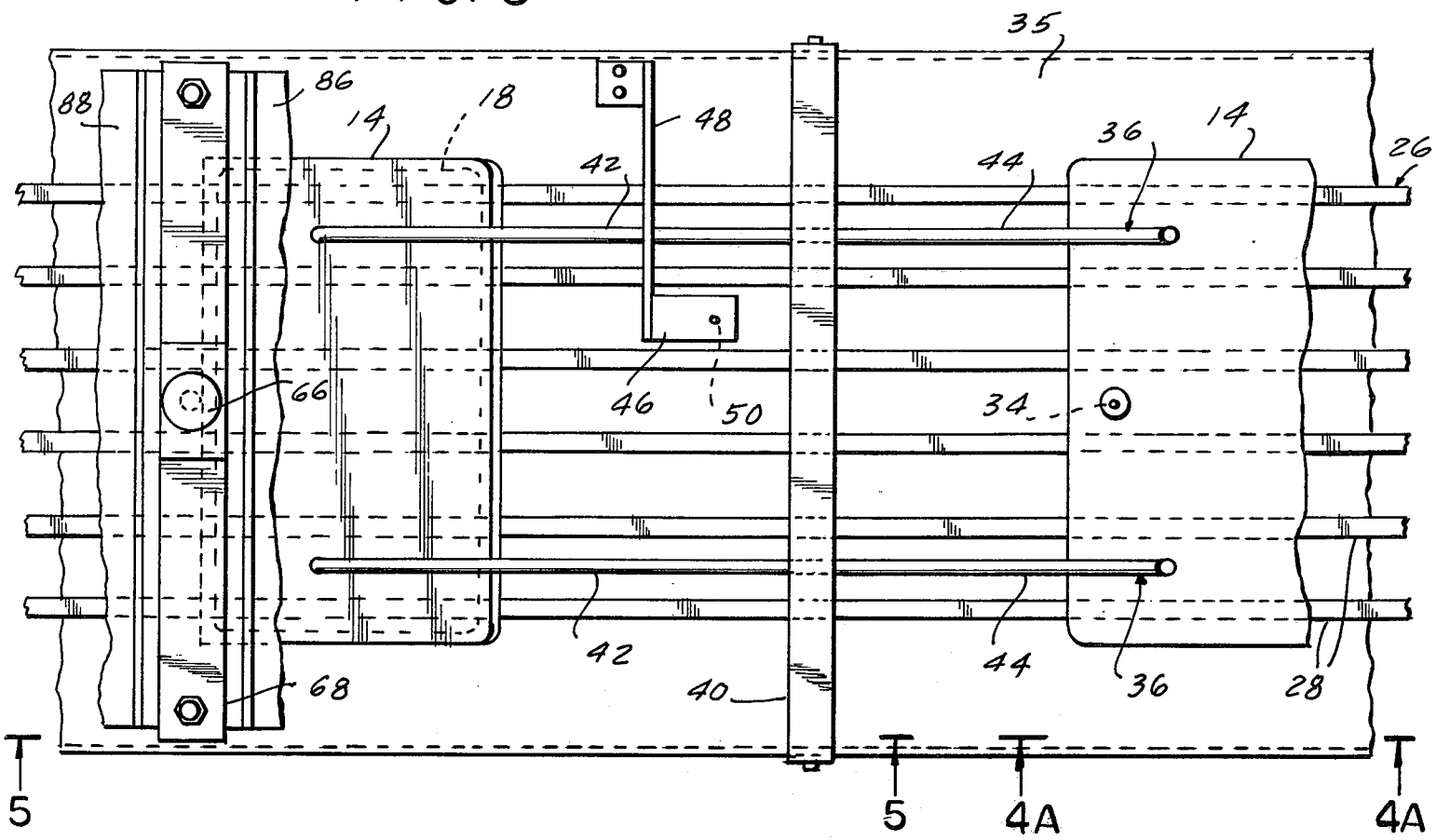
FIG. 3 is an enlarged fragmentary plan view of the card folding and creasing device.

With regard now to the FIGS. 1 and 2, there is schematically shown a system for dispensing a card, which receives sliced product thereon, and folding and creasing said card usually prior to sealing it in clear plastic.

While shown, the card dispenser 10 does not per se constitute the present invention, however, a brief discussion as to its operation is helpful. The dispenser usually includes a hopper 12 in which is contained a plurality of cards 14. These cards 14 are usually made of cardboard and may be laminated or otherwise plastic coated so as to be impervious to oils that may be in the sliced product. Depending on application, a fold line 16, which may be perforated to facilitate folding may be located in approximately the center of the card. This allows approximately half of the card to receive the product, with an approximately equal half available to be folded over the product. Of course, as will be evident, any shape or size card may be readily utilized with appropriate adjustments to the devices.

The product 18, here being for example pork strips or bacon, is fed towards the hopper 12 via a conveyor 20 consisting of a plurality of spaced endless belts 22 about a roller arrangement 24. When the product reaches a predetermined point, a card 14 is dispensed from the hopper 12, under the conveyor 20, and fed contemporaneously with that of the product so that the product, as it leaves the conveyor 20 is fed onto the trailing portion of the card. This is easily seen in FIG. 2, where the product 18 is shown just prior to its being fed onto the card 14.

An example of a card dispenser which applicants have found particularly useful in the above system is that disclosed and described in commonly assigned U.S. patent application Ser. No. 143,529 entitled Automatic Card Dispenser and Pick-Off Assembly, filed contemporaneously herewith.

Once the product has been placed onto the card, it is fed onto a second conveyor 26, which similarly consists of a plurality of spaced endless belts 28 driven about a plurality of rollers 30. This conveyor 26 feeds the card and product thereon into the folding device 32. This device is most clearly seen in FIGS. 3–7 and includes an air nozzle or jet 34, supported by a table or other support surface 36 and connected via lead 38 to a source of forced air. The air nozzle 34 is disposed beneath the conveyor 26, and as shown perpendicular thereto. Of course, the angle of disposition of the air nozzle may be varied as desired in operation, and although a single nozzle is shown, it is contemplated that a plurality of nozzles may also be utilized, dispersed laterally across the conveyor, if so desired.

Figure 4A:
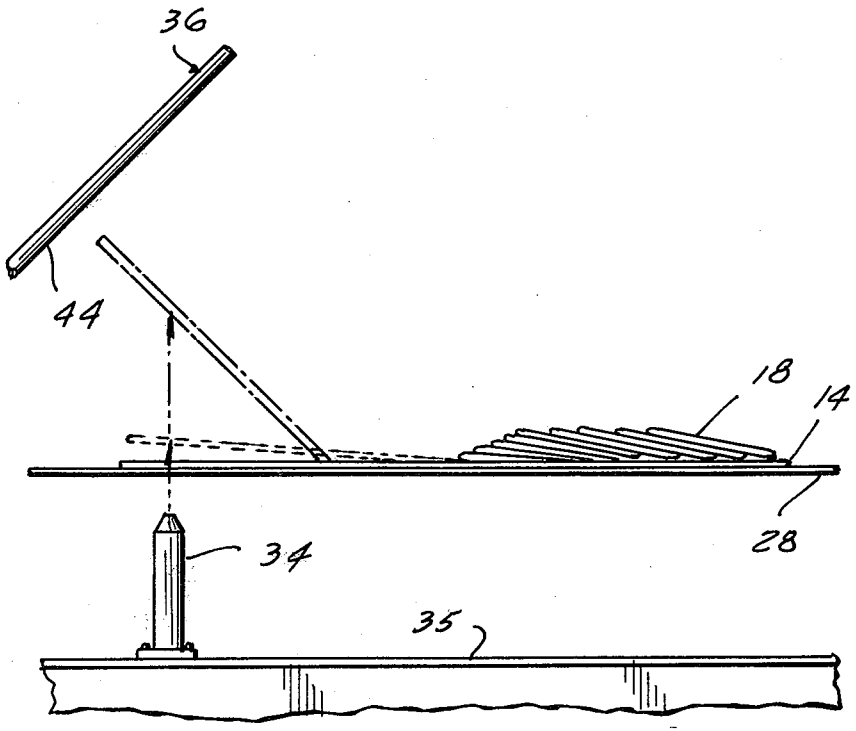
FIGS. 4A–4B depicts the operation of the air jet in raising the leading portion of the card prior to its engagement with the fingers.
Figure 4B:
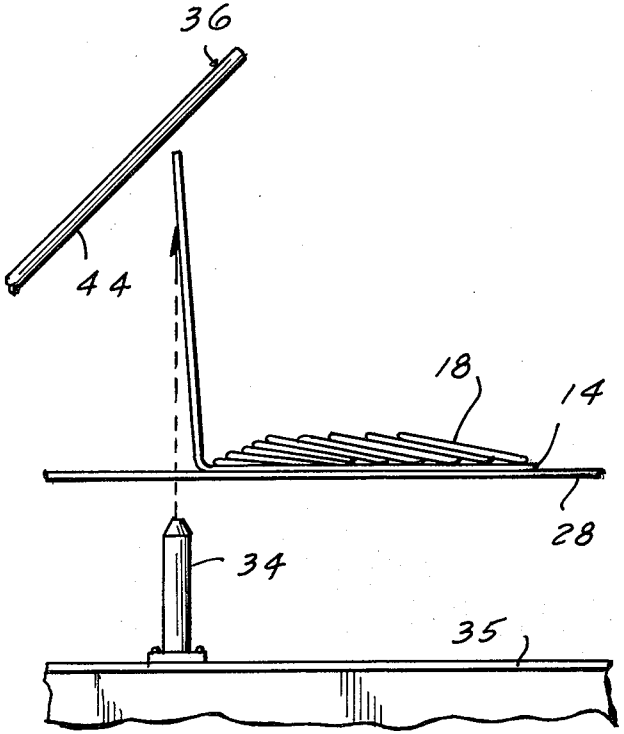

As can be seen in FIGS. 4A–4B, the air nozzle 34 provides a stream of air upward which contacts the leading portion of the card 14 bending it upward into a somewhat perpendicular position to that of the conveyor as the card with product thereon passes over the nozzle 34. Since the card does have product thereon, it is provided with sufficient weight to prevent it from being blown off the conveyor 28. If no product is disposed thereon, the card may be blown off the conveyor, advantageously eliminating it from further processing.

It should be noted that depending upon the speed of operation, the nozzle 34 may be continuous or intermittent in its operation. If intermittent, the nozzle 34 operation could be controlled by a limit switch or photoelectric eye which would provide a signal as to the approaching card. Also, while an air jet is utilized in this regard, a reciprocal type mechanical device could also be utilized.

As can best be seen in FIGS. 3–6, once past the air nozzle 34, and while the leading portion of the card is in its raised position, the card is fed into a plurality of fingers 36 laterally disposed above the conveyor 28 and supported by a U-shaped bracket 40, which in turn is supported by the table 36. The connections between the fingers, bracket, and table may be welded or by any other means as desired.

As shown the fingers 36 are obtuse in shape having a portion 42 parallel to the conveyor, with a portion 44 adjacent nozzle 34, bent upwards.

Figure 5:
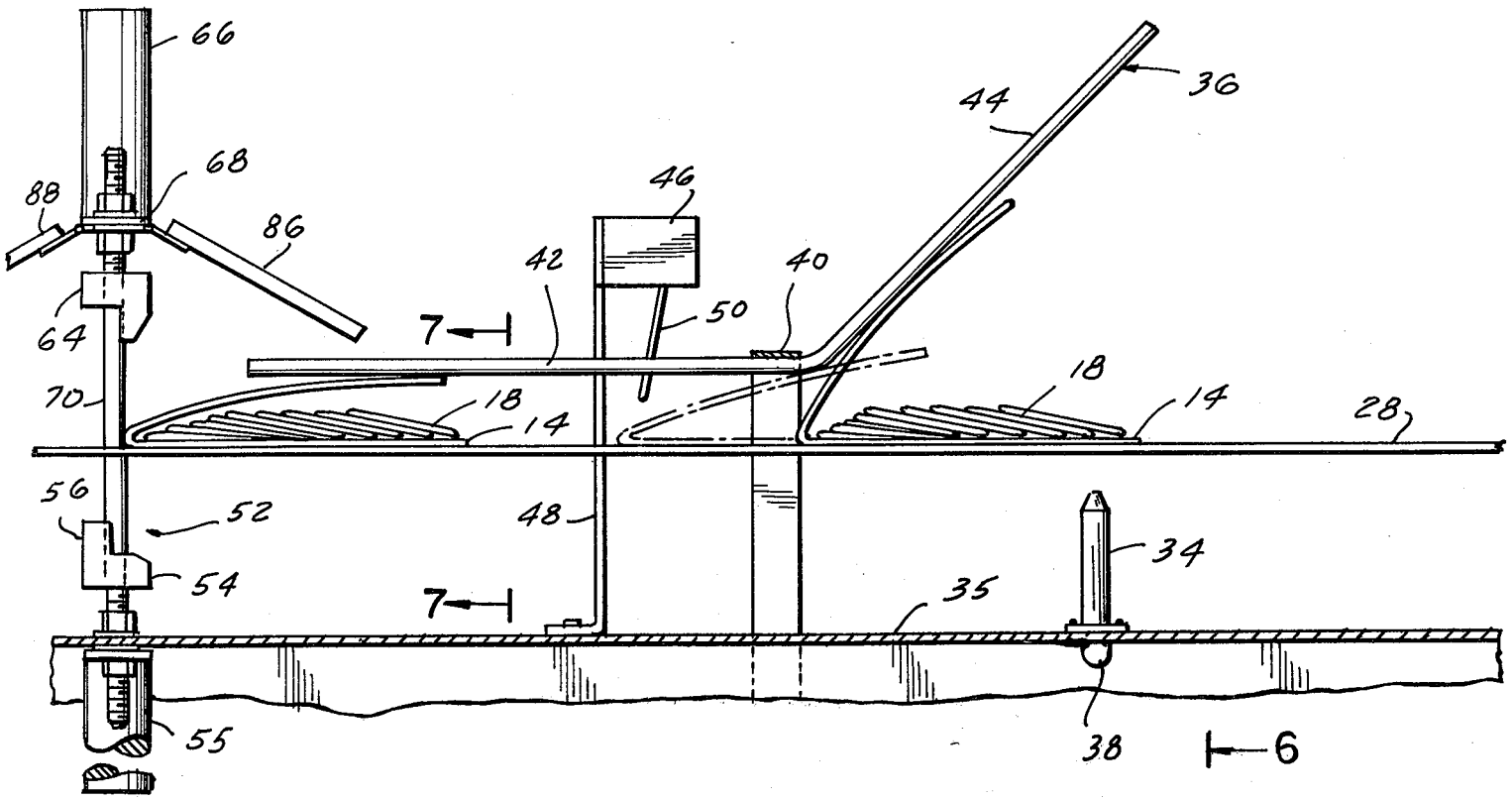
FIG. 5 is a side elevation view of the card folding and creasing device taken along lines 5—5 of FIG. 3.
Figure 6:
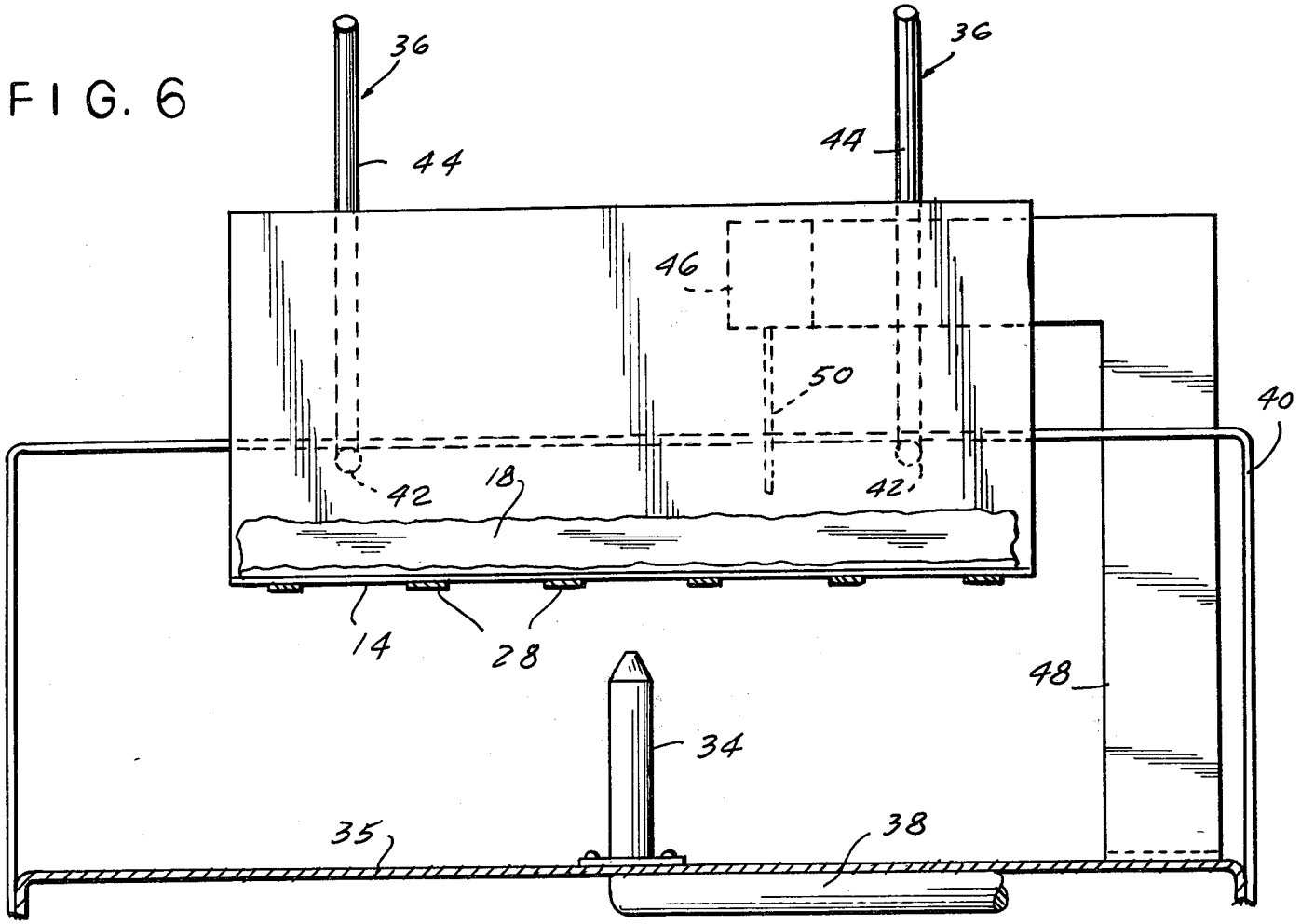
FIG. 6 is a fragmentary sectional view taken along lines 6—6 of FIG. 5.
Figure 7:
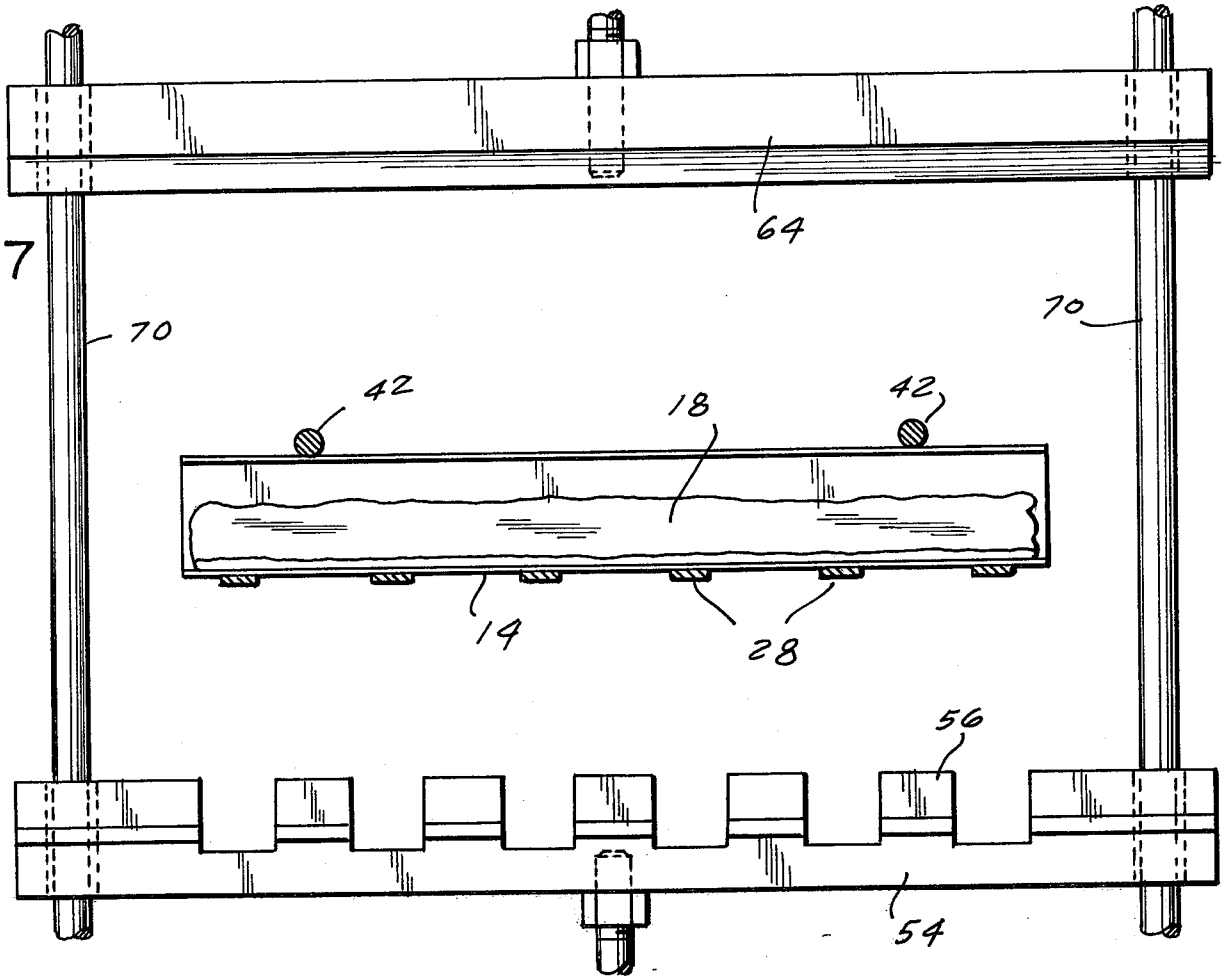
FIG. 7 is a fragmentary sectional view taken along lines 7—7 of FIG. 5, prior to creasing of the card.
Figure 8:
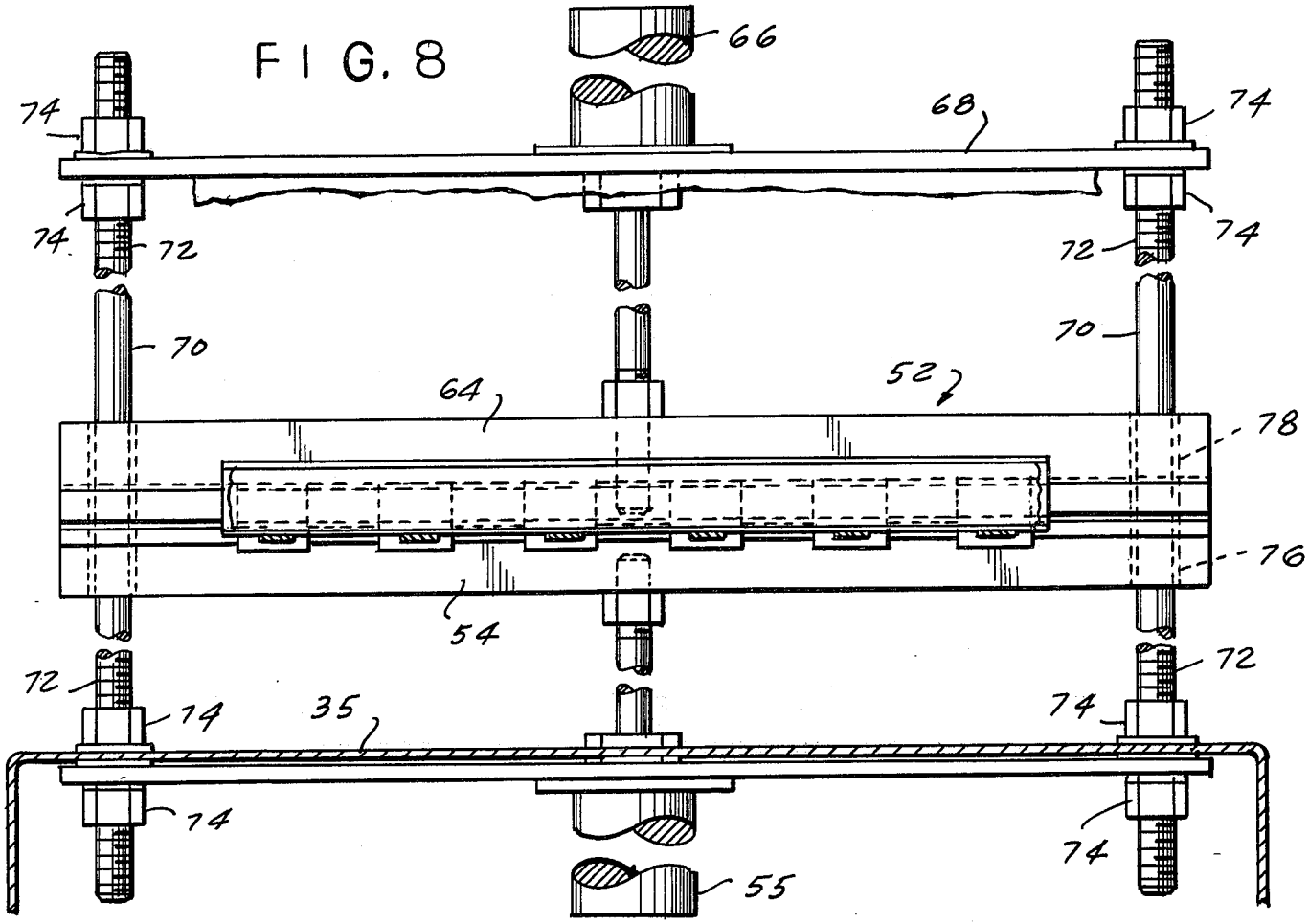
FIG. 8 is a view similar to FIG. 7, however, with the card being creased.

The bent portion 44 serves to initially contact the raised portion of the card 14, gradually folding it back as it moves along the conveyor, as shown most clearly in FIGS. 5–7. The parallel portion 42, located sufficiently above the conveyor 28, so as to not interfere with the passing product, serves to complete the folding back of the card.

While two fingers 36 are shown, and are in the form of bent rods, the shape and number may be varied as desired as long as they function to sufficiently fold back the card. Also, while it is desirable that the fingers have an upwardly bent portion 44 to gradually fold back the card, the shape of this portion may also vary as desired and may even be eliminated depending upon application.

A proximity switch 46 is provided and supported via bracket 48 above the conveyor, and interposed between the fingers 36. An arm 50 extends downward therefrom and is of predetermined length so as to engage the now folded portion of the card, but of a sufficient height that it is above the passing product.

The reason for this is that switch 46 provides a signal which raises the stop-bar 54 of the creasing mechanism 52 as hereinafter discussed. By being so positioned, should for some reason the card not be folded, or nonexisting, the product or unfolded card with product thereon would pass through the creasing mechanism 52 without mutilation of the product and thereafter treated accordingly.

Figure 9A:
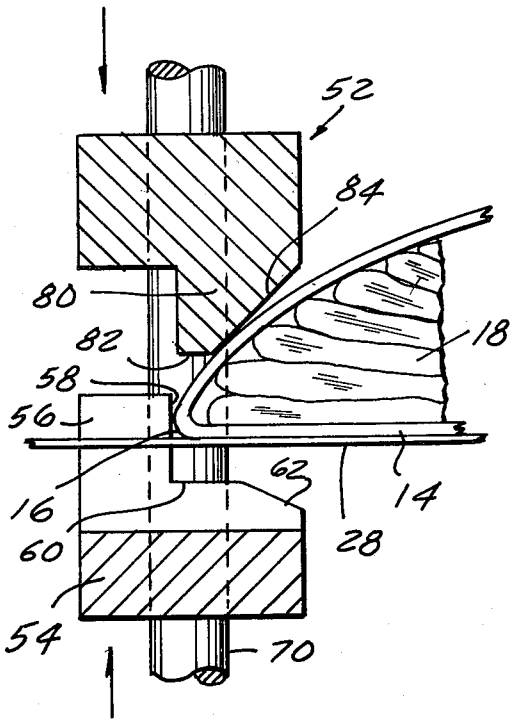
FIGS. 9A–9C are enlarged operational views in section showing the creasing of the card along the fold line.
Figure 9B:
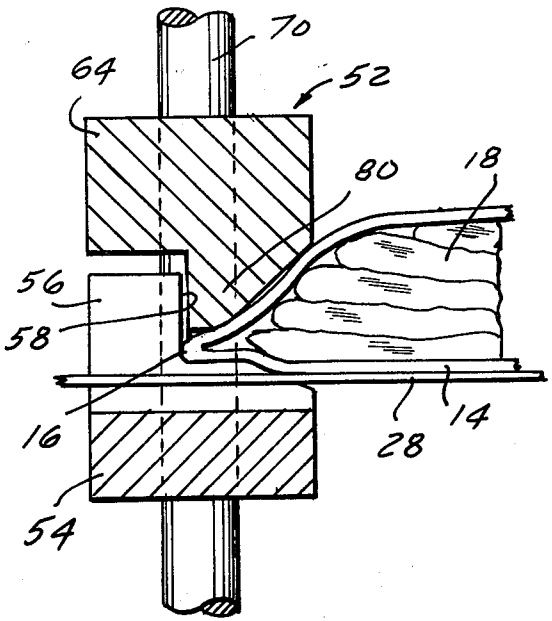

Upon being signalled, by way of conventional circuitry or pneumatic or hydraulic means, the stop-bar 54 is raised via cylinder-piston assembly 55 supported by table 36. As shown, the stop-bar 54 comprises a plurality of vertically extending lugs serving as stops 56. The assembly 55 may be electrical, pneumatical, or hydraulically actuated, with said stops 56 positioned so as to be interposed between the belts 28 or the conveyor 26 in its raised position so that the leading edge or fold line 16 of the card 14 is stopped by the perpendicular surface 58 of the stop 56, with surfaces 60 and 62 also provided to facilitate creasing as shown in FIGS. 9A and 9B hereinafter discussed. With the continuous running of the belts 28, the stops serve to straighten out the now folded card 14 prior to creasing if askew or not perpendicular to the axis of travel.

A reciprocal upper bar 64 is provided to be connected to a piston-cylinder assembly 66 and serves in cooperation with the raised stop-bar 54 to crease the card 14. Support for the upper bar 64 and assembly 66 is provided by a bracket 68, which may be supported by the table 36 via guide rails 70 having a portion 72 thereof threaded so as to enable bolts 74 to affix the rails to the support table 36 and maintain bracket 68 in position. Each of the bars 54 and 64 are provided with bearings 76 and 78, respectively, which allow the bars to ride on said rails 70, thus maintaining the bars in a vertical position with respect to each other. Since the upper bar 64 will meet the stop-bar 54 above the conveyor 28, as shown clearly in FIG. 9B, its downwardly extending portion 80 may be continuous or intermittent as desired, so long as surface 82 thereof cooperates with surface 60 on the stop-bar 54 in forming the crease. Portion 80 may also be provided with a surface 84, which similar to surface 62 of the stop-bar is divergent away from the product, to facilitate creasing while not mutilating the product.

Figure 9C:
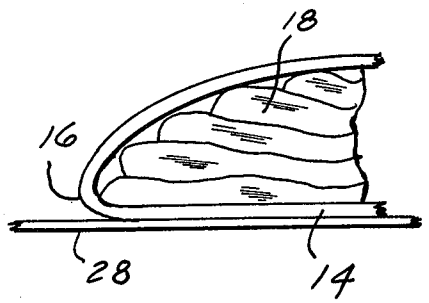

The interrelation of the bars 54 and 64 during creasing can be seen in FIGS. 9A–9C, wherein 9A depicts the card 14 in its folded position abutting surface 58 just prior to creasing, with bars 54 and 64 moving towards each other. In FIG. 9B the bars 54 and 64 and corresponding surfaces thereon, serve to press or crease the card along its foldline 16, while it is in its stopped position. The motion of the bars towards each other may be simultaneous or staggered as desired with perhaps a short delay for the card to straighten out, before the upper bar 64 moves towards the stop-bar 54 in creasing action. Once a crease is effected, the piston-cylinder assemblies shortly thereafter retract the bars as shown in FIG. 9C, allowing the now creased card 14 to continue along the conveyor 28.

The creasing mechanism 52 may also be provided with safety gates 86 and 88, formed for example, from clear plastic, i.e., plexiglass, etc., located on either side of bars 56 and 58 and rotatably supported by bracket 68 to prevent a person from inadvertently placing his hand in the creasing mechanism 52 during operation. In this regard, the gates may be so arranged that upon lifting from their FIG. 5 position, they would engage a switch or valve which would automatically, via conventional connections, deactivate the cylinders, stopping operation of the creasing mechanism. This would insure that the creasing mechanism 52 is always disengaged when an employee is perhaps cleaning the mechanism or removing a blockage that might occur therein. A return of the gates 86 and 88 to the down position allows for normal operation of the creasing mechanism 52. Should the build-up of cards 14 occur at the input or output of the creasing mechanism 52, so as to cause either gate to rise, the creasing operation will automatically stop thereby automatically preventing mutilation of cards and/or products, etc.

A representative example of connections for operation of the creasing mechanism 52 in conjuntion with the safety gates is shown in FIG. 2 and includes two switches 90 and 92 connected to cylinders 66 and 65, respectively. These switches are activated through their engagement with the gates directly or via connecting line 94, which may originate from a limit switch which is activated by the raising of the safety gates. The activity of the piston-cylinder assemblies may be regulated by the switches, deactivating the creasing mechanism according to the position of the gates.

In actual practice, it has been determined that the card folding and creasing device of this invention eliminates up to five persons per line heretofore deployed for folding the cards 14. Only one person is required to load and replenish the magazine 12 from time-to-time when needed. There has been realized approximately up to $100,000 savings per line, per shift, and up to approximately one quarter of a million dollars a year per line by utilizing the teachings of this invention.

While the preferred embodiment of the device has been disclosed and discussed in detail herein, it should be understood that its scope should not be limited thereby, rather its scope should be determined by that of the appended claims.

What is claimed is:

1. A folding and creasing device for a card having thereon sliced food products, comprising:

a source of segregated sliced food product;

a source of supply of card with each card having a leading end and a trailing end and having a fold line intermediate these ends;

means for depositing the segregated sliced food product on the card between the fold line and the trailing end;

conveyor means for conveying the card with sliced product thereon;

folding means for folding the leading end of the card rearwardly about the fold line over the upper part of the sliced product on the card while travelling on the conveyor means; and creasing means for creasing the folded card at the fold line and thereafter permitting the conveyor means to take away the creased folded card with sliced product thereon, the creasing means including a vertically reciprocal lower stop bar having a vertical surface for moving into the path of the folded card for momentarily stopping the folded card with sliced product thereon for assuring that the fold line is essentially normal to the line of travel of the folded card with sliced product on the conveyor means and having an upper horizontal surface for engaging the folded card at the fold line for creasing the folded card, means for raising said stop bar, the creasing means further including a vertically reciprocal upper bar means for lowering each upper bar into engagement with the folded card at the fold line while the folded card is momentarily stopped by the stop bar and in cooperation with said horizontal surface of said stop bar creasing the card at the fold line.

2. The invention in accordance with claim 1, wherein the folding means includes a lifting means for lifting the leading end of the card upwardly about the fold line and folding fingers for urging the lifted leading end of the card rearwardly over the sliced product.

3. The invention in accordance with claim 2, wherein the lifting means includes a jet of air.

4. The invention in accordance with claim 2, wherein the folding fingers include an essentially horizontal trailing end that maintains the card in its folded position until and during creasing.

5. The invention in accordance with claim 1, wherein a proximity switch is disposed along the conveyor means to actuate the creasing means when the folded card is in a certain relation with respect to the folding means while travelling on the conveyor means.

6. The invention in accordance with claim 5, wherein the proximity switch is so constructed and arranged to not be tripped by segregated sliced food product without a folded card thereby maintaining the creasing means in a deactivated position to prevent multilation of the sliced products by the creasing means travelling without a card.

7. The invention in accordance with claim 1, wherein the conveyor means includes several parallel spaced chains mounted on rollers and the stop bar includes a plurality of vertically projecting fingers having a vertical face against which the card is adapted to impact while travelling on the conveyor when the stop bar is raised from a lower position to a raised position at which the card is momentarily stopped for creasing.

8. The invention in accordance with claim 1, wherein delay means are coupled with the upper bar to delay lowering of the upper bar until after the stop bar has been raised to momentarily stop the folded card with sliced product thereon.

9. The invention in accordance with claim 1, wherein the raised stop bar lifts the card at the fold line above the elevation of the conveyor means.

10. The invention in accordance with claim 9, wherein both the stop bar and the upper bar include a pair of opposed parallel surfaces which when the stop bar is raised and the upper bar is lowered are in close proximity to one another while creasing the card at the fold line.

11. The invention in accordance with claim 10, wherein the stop bar parallel surface includes an essentially flat face which includes a downwardly inclined cam face spaced from the vertical stop face to assure entry of the fold line of the card onto the flat face of the stop bar and against the vertical stop face.

12. The invention in accordance with claim 1, wherein safety gate means are coupled with the creasing means to deactivate the creasing means and prevent creasing when the gate means is open and to activate the creasing means when the gate means is closed.

* * * * *